US008370979B2

(12) United States Patent
Fukano

(10) Patent No.: US 8,370,979 B2
(45) Date of Patent: Feb. 12, 2013

(54) MATTRESS

(75) Inventor: Michihiro Fukano, Saitama (JP)

(73) Assignee: Nitori Holdings Co., Ltd. (JP)

( * ) Notice: Subject to any disclaimer, the term of this patent is extended or adjusted under 35 U.S.C. 154(b) by 0 days.

(21) Appl. No.: 13/265,275

(22) PCT Filed: Dec. 25, 2009

(86) PCT No.: PCT/JP2009/007273

§ 371 (c)(1),
(2), (4) Date: Jan. 3, 2012

(87) PCT Pub. No.: WO2010/122625

PCT Pub. Date: Oct. 28, 2010

(65) Prior Publication Data

US 2012/0096649 A1 Apr. 26, 2012

(30) Foreign Application Priority Data

Apr. 23, 2009 (JP) ..... 2009-104658

(51) Int. Cl.
*A47C 27/15* (2006.01)

(52) U.S. Cl. ..... 5/720; 5/716; 5/740

(58) Field of Classification Search ..... 5/720, 716, 5/722, 729, 737–740

See application file for complete search history.

(56) References Cited

U.S. PATENT DOCUMENTS

| | | | | |
|---|---|---|---|---|
| 1,192,510 A | | 7/1916 | Fischmann | |
| 5,740,574 A | | 4/1998 | Piraino | |
| 5,970,547 A | * | 10/1999 | Cavazos | 5/690 |
| 7,757,322 B2 | * | 7/2010 | An | 5/722 |
| 2008/0098533 A1 | | 5/2008 | Erdman | |
| 2009/0038080 A1 | | 2/2009 | Grigg | |

FOREIGN PATENT DOCUMENTS

| | | |
|---|---|---|
| JP | 06-019613 | 3/1994 |
| JP | 07-028462 | 5/1995 |
| JP | H10-35737 A | 2/1998 |
| JP | 11-056536 | 3/1999 |
| JP | 2000-128246 A | 5/2000 |

(Continued)

OTHER PUBLICATIONS

International Search Report; PCT/JP2009/007273; Feb. 16, 2010.
The Supplemental European Search Report dated Oct. 9, 2012, which corresponds to European Patent Application No. 09 84 3625 and is related to U.S. Appl. No. 13/265,275.

(Continued)

*Primary Examiner* — Fredrick Conley
(74) *Attorney, Agent, or Firm* — Studebaker & Brackett PC; Donald R. Studebaker

(57) ABSTRACT

Provided is a mattress wherein the elastic characteristics of each portion can be changed simply and inexpensively depending on the user's preference. A mattress (10) has a plurality of spring units (60, 70, 80, 90) respectively constituted by holding a plurality of vertically stretchable pocket coils integrally, a lower elastic body (40) in which a housing space (44) capable of housing and holding the spring units (60, 70, 80, 90) is formed, and an upper enclosure (21) and a lower enclosure (30) for covering the outer periphery of the lower elastic body (40), wherein the lower elastic body (40) is provided with a partitioning elastic body (50) for dividing the housing space (44) into a plurality of spaces, and the spring units (60, 70, 80, 90) are formed in such a shape that each of the spring units can be housed in the divided housing spaces (44), and are housed and held in the respective divided housing spaces (44).

8 Claims, 6 Drawing Sheets

FOREIGN PATENT DOCUMENTS

| | | | |
|---|---|---|---|
| JP | 2002-223901 | A | 8/2002 |
| JP | 2004-205231 | A | 7/2004 |
| JP | 2005-206250 | A | 8/2005 |
| JP | 2007-119020 | A | 5/2007 |
| WO | 2009/048209 | A1 | 4/2009 |

OTHER PUBLICATIONS

Japanese Office Action dated Dec. 7, 2012, which corresponds to Japanese Patent Application No. 2009-104658 and is related to U.S. Appl. No. 13/265,275.

* cited by examiner

MATTRESS

TECHNICAL FIELD

The present invention relates to a mattress constituted so that spring units are housed within an enclosure.

TECHNICAL BACKGROUND

The above-mentioned mattress generally is configured to have an interior provided with spring units formed so that a plurality of pocket coils formed so as to house coil springs is held integrally in a row in a planar shape, and an outer periphery is covered by an enclosure with favorable texture or the like. From such a configuration, when, for example, a user reclines on the mattress, the coil springs are depressed and contracted in accordance with the load (the weight of the user), and the mattress (coil springs) becomes moderately depressed. The user can therefore maintain a natural sleeping position and is able to obtain a comfortable sleep, without excessive pressure being applied to the body.

The mattress hardness (the extent of the depression) that feels comfortable for sleeping varies for each user. For example, while there are some users that prefer a mattress with comparatively hard elastic characteristics less likely to be depressed under a load, there are other users that prefer a mattress with comparatively soft elastic characteristics that is easily depressed. A variety of mattresses have conventionally been developed to meet such various user preferences. For example, FIG. 1 of Patent Document 1 discloses a mattress configured so that a plurality of pocket spring assemblies 2 having different elastic characteristics is prepared and the pocket spring assembly 2 provided with desired elastic characteristics is selected and housed in a cushion frame 1.

In recent years, rather than configuring the entire mattress to have the same elastic characteristics, there has been a demand for a mattress configured so that each portion has different elastic characteristics in accordance with the user preference. The use of such a mattress makes it possible to have a configuration in which, for example, the elastic characteristics are different at the upper body and at the lower body, enabling further improved comfort.

PRIOR ARTS LIST

Patent Document

Patent Document 1:Japanese Laid-open Patent Publication No. H11-56536(A)

SUMMARY OF THE INVENTION

Problems to be Solved by the Invention

Using the mattress of the configuration illustrated in Patent Document 1 to meet the above demand necessitates that pocket coils with partially different elastic characteristics be lined up in accordance with the user preference and that the pocket coils be integrated together to produce a personalized pocket spring assembly. For this reason, when, for example, the elastic characteristics of the mattress do not fit the body, and a mattress having different elastic characteristics is desired, another pocket spring assembly that is personalized according to the new preference must be separately manufactured. Accordingly, because of the costs needed to manufacture another personalized pocket spring assembly whenever there is a decision to change the elastic characteristics of the mattress, it is difficult to change the elastic characteristics easily and while minimizing costs, which is a problem.

The present invention has been made in view of the above problems, and an object thereof is to provide a mattress in which it is possible to easily change the elastic characteristics at each portion depending on user preference.

Means to Solve the Problems

In order to achieve the object described above, the mattress according to the present invention comprises a plurality of spring units respectively constituted by holding a plurality of vertically stretchable coil springs integrally, a housing holding member (for example, the lower elastic body 40 in the embodiments) in which a unit-housing recess (for example, the housing space 44 in the embodiments) capable of housing and holding the plurality of spring units is formed, and an enclosure (for example, the upper enclosure 21 and lower enclosure 30 in the embodiments) for covering the outer periphery of the housing holding member, with the housing holding member being provided with a dividing member (for example, the partitioning elastic body 50 in the embodiments) for dividing the unit-housing recess into a plurality of divided housing recesses, and the plurality of spring units being formed in such a shape that each of the spring units can be housed in the divided housing recesses, and being housed and held in the respective recesses of the plurality of divided housing recesses.

In a preferred configuration, the elastic characteristics, as measured in the vertical direction, of one of the spring units constituting the plurality of spring units are different from the elastic characteristics of at least one other of the spring units in the vertical direction.

In the above-described mattress, it is preferable that the dividing member be formed using an elastically deformable plate-shaped member and be housed in the unit-housing recess, and that the dividing member, when housed in the unit-housing recess, have irregularities in the vertical direction (for example, the upper projections 51 and lower projections 53 in the embodiments) formed on at least one of the end faces in the vertical direction.

Preferably, the housing holding member is provided with the unit-housing recesses formed to be substantially box-shaped using an elastically deformable material so that the top surface in the vertical direction is depressed, and laterally extending irregularities (for example, the lateral projections 43 in the embodiments) are formed on the inner side surfaces facing the side of the spring units in the housing holding member in a state in which the spring units are housed and held in the divided housing recesses.

The mattress according to the present invention has a plurality of spring units respectively constituted by holding a plurality of vertically stretchable coil springs integrally, a housing holding member provided with a plurality of unit-housing recesses capable of housing and holding each of the spring units, an enclosure for covering an outer periphery of the housing holding member, and the plurality of spring units being formed in such a shape that each of the spring units can be housed in the unit-housing recess and are housed and held in the respective recesses of the plurality of unit-housing recesses.

In a preferred configuration, the elastic characteristics, as measured in the vertical direction, of one of the spring units constituting the plurality of spring units are different from the elastic characteristics of at least one other of the spring units in the vertical direction.

Advantageous Effects of the Invention

The mattress according to the present invention is configured so that a housing holding member for housing and holding spring units is provided with a dividing member for dividing a unit-housing recess into a plurality of divided housing recesses, and each of the plurality of spring units is housed and held in the respective recess of the plurality of divided housing recesses. This configuration is able to provide a mattress made to have the elastic characteristics desired by the user, for example, by inserting a spring unit having desired elastic characteristics into a desired location (divided housing recess). In a case in which the elastic characteristics of each portion are to be altered, the spring unit inserted into the divided housing recess may be merely replaced by a spring unit formed to the desired elastic characteristics. In the mattress according to the present invention, therefore, it is possible to easily alter the elastic characteristics at each portion in accordance with the user preference.

In a preferred configuration, the elastic characteristics of one of the spring units constituting the plurality of spring units are different from the elastic characteristics of at least one other spring unit. In this case, the mattress can be configured to have different elastic characteristics at each portion. A configuration can therefore be adopted in which the elastic characteristics are different at, for example, the upper body and lower body, making it possible to provide a mattress faithfully reflecting the user preference and having enhanced comfort.

In a preferred configuration, the mattress described above has a dividing member formed using an elastically deformable plate-shaped member, and has irregularities that extend in the vertical direction formed on at least one of either the upper surface or the lower surface thereof. For example, forming the irregularities that extend in the vertical direction on the upper surface of the dividing member allows the dividing member and the enclosure for covering the unit-housing recess from above to be brought into contact with each other along the irregularities that extend in the vertical direction. In other words, the enclosure and the dividing member can be brought into contact with each other at points rather than along a plane. For this reason, the user can be guaranteed comfort without being inconvenienced, because when a load is applied to the mattress, the irregularities that extend in the vertical direction are easily depressed and the dividing member is depressed to the same extent as the spring unit.

In a preferred configuration, laterally extending irregularities are also formed on the inner sides facing the side surface of the spring units in the housing holding member. Upon insertion of a spring unit into a divided housing recess, the spring unit is sometimes displaced during insertion, creating an interference between the inner side surface of the housing holding member and the side surface of the spring unit. In so doing, the inner side surface of the housing holding member is tilted at an angle, and, for example, the zipper that connects the exterior bodies together is difficult to close. By contrast, in the configuration in which the above-described laterally extending irregularities are formed, the inner side surface of the housing holding member and the side surface of the spring unit can be brought into contact with each other along the laterally extending irregularities. In other words, the housing holding member and the spring unit can be brought into contact with each other at points rather than along a plane. Accordingly, when the spring unit is displaced during insertion, the laterally extending irregularities are depressed, thereby making it possible to easily position the inner side surface of the housing holding member substantially straight in the up-down direction. The zipper that connects the exterior bodies together can therefore be reliably closed regardless of the insertion position of the spring unit.

The mattress according to the present invention has a housing holding member in which a plurality of unit-housing recesses capable of housing and holding the spring units is formed, and is configured so that the plurality of spring units is housed in the respective unit-housing recess. This configuration enables the integral formation of the housing holding member using a molding die or the like. Accordingly, the number of parts can be reduced and the manufacturing costs curtailed compared with, for example, a configuration that uses separate dividing members in order to divide the unit-housing recess into a plurality of recesses.

In a preferred configuration, the elastic characteristics of one of the spring units are different from the elastic characteristics of at least one other spring unit. With this configuration, the mattress can be configured to have different elastic characteristics at each portion. Accordingly, a configuration can be adopted in which different elastic characteristics are provided, for example, to the upper body and the lower body, and a mattress can be provided in which the user preference is faithfully reflected and comfort is further enhanced.

DESCRIPTION OF THE EMBODIMENTS

Embodiments of the present invention will be described below with reference to the drawings. For convenience of explanation, the description will be provided by defining the directions of the arrows depicted in each drawing as front-rear, left-right, and top-bottom. First, the configuration of a mattress 10 in which the present invention is adopted will be described with reference to FIG. 1 to FIG. 3. The mattress 10 described below is illustrated with a double-bed mattress having the elastic characteristics of a softer front side and a harder rear side.

Figure 1:
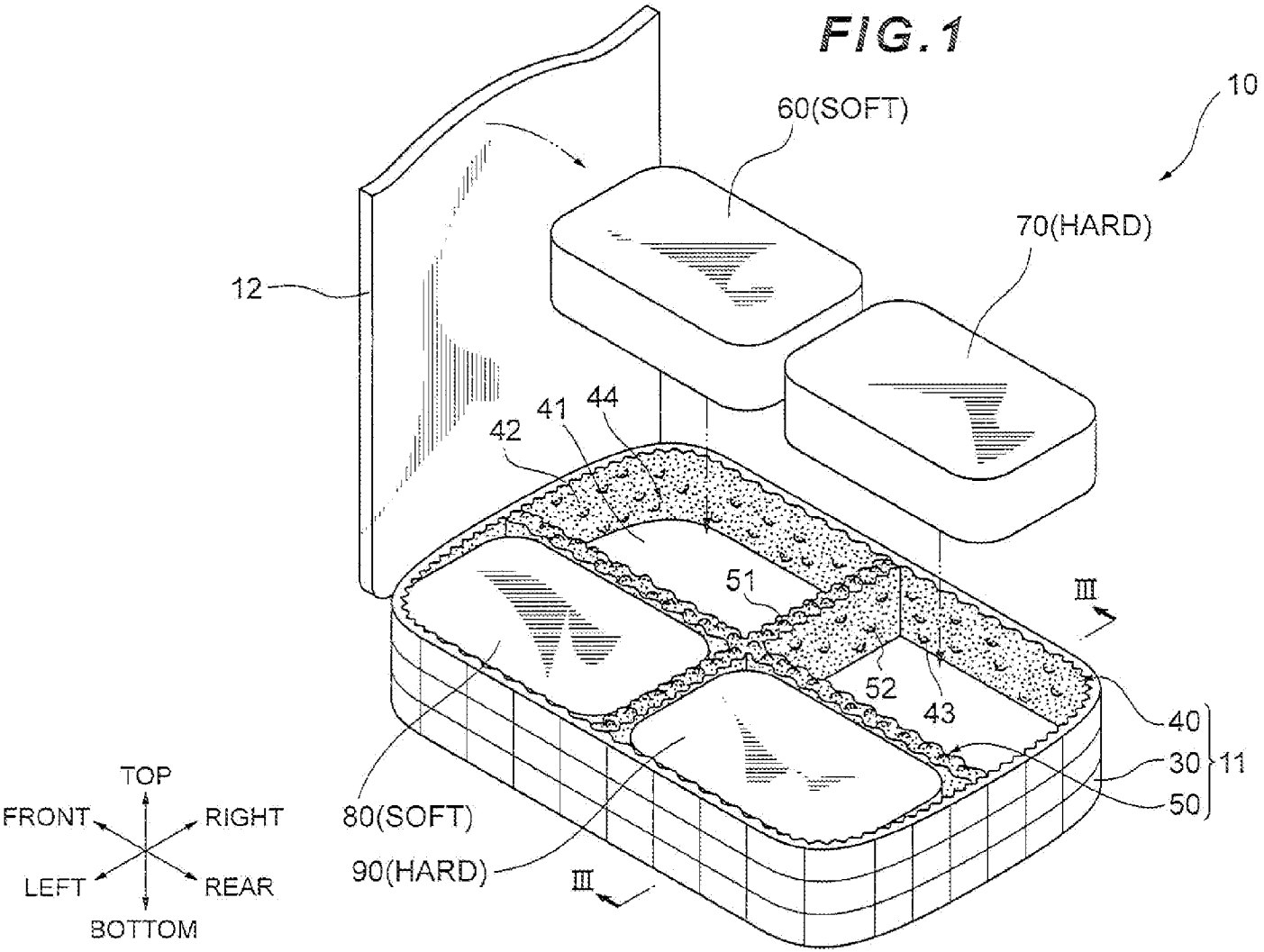
FIG. 1 is a perspective view of a mattress in which the present invention is adopted.

The mattress 10, as depicted in FIG. 1, is primarily constituted of a lower housing unit 11 formed in a substantially rectangular cuboid, and an upper layer unit 12 covering the upper surface of the lower housing unit 11. The lower housing unit 11 is constituted of a lower enclosure 30, a lower elastic body 40, a partitioning elastic body 50, and spring units 60, 70, 80 and 90.

The lower elastic body 40, as depicted in FIG. 1, is constituted of a base unit 41 formed in a substantially rectangular shape in plan view from above, and a side wall unit 42 extending upward from the rim of the base unit 41. As seen from FIGS. 1 and 3, a housing space 44 of a substantially cuboid shape is formed by the base unit 41 and the side wall unit 42 in the central portion of the lower elastic body 40. A plurality of lateral projections 43 about 10 mm in height is formed on the inner side surface of the side wall unit 42 so as to protrude inward. The lower elastic body 40 is formed using an elastic material such as urethane resin.

The lower enclosure 30 covers the bottom surface and side surface of the lower elastic body 40. The lower enclosure 30 is formed with layers of, for example, a non-woven cloth, an elastic urethane resin, polyester fibers, and a softly textured surface fabric, or the like (not shown), in order from the inside (from the lower elastic body 40).

The partitioning elastic body 50 is formed using an elastic material such as urethane resin. Further, as depicted in FIG. 1, the partitioning elastic body 50 is formed by the crosswise combination of two urethane resin plates. A plurality of upper projections 51 is formed on the upper surface of the partitioning elastic body 50, a plurality of lateral projections 52 is formed on the side surfaces thereof, and lower projections 53 are formed on the lower surface thereof (see FIGS. 1 and 3). The vertical height of the partitioning elastic body 50 is substantially equal to the vertical height of the side wall unit 42.

Figure 2:
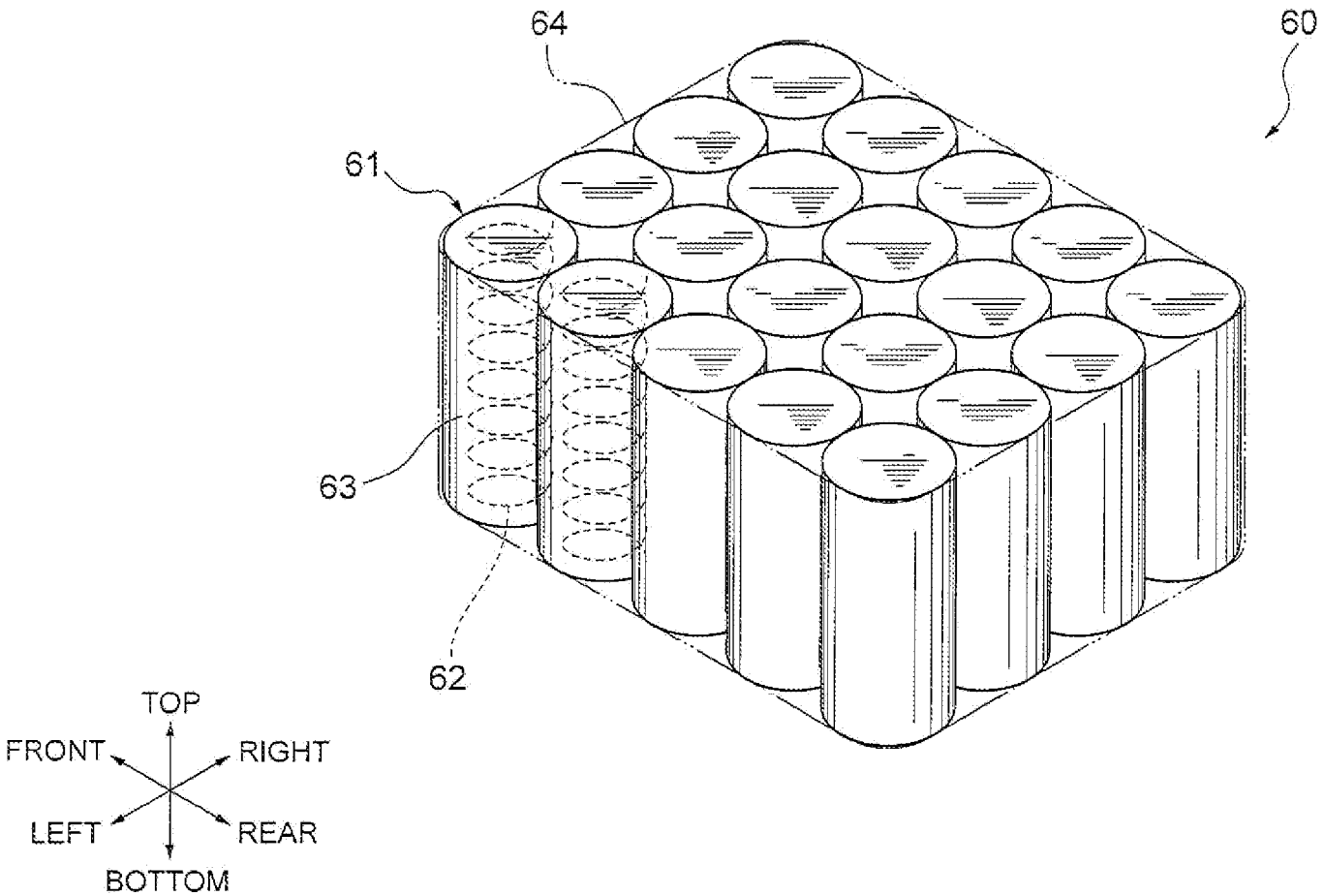
FIG. 2 is a perspective view of a spring unit.

The spring unit 60, as depicted in FIG. 2, is constituted of a plurality of pocket coils 61 and a unit-forming member 64. In FIG. 2, the unit-forming member 64 is shown by the two-dashed lines so as to facilitate understanding of the interior configuration of the spring unit 60.

Each of the pocket coils 61 is constituted of a coil spring 62 and a coil-housing bag body 63. The coil spring 62 is formed by a helically wound elongated metal wire. The coil spring 62 is housed within the coil-housing bag body 63, which is formed in a substantially cylindrical shape using cloth, for example. The unit-forming member 64 is formed into a substantially rectangular cuboid bag shape using cloth, for example. The plurality of pocket coils 61 thus configured is housed within the unit-forming member 64 in an orientation that allows stretching in the up-down direction. FIG. 2 illustrates the spring unit 60 formed by the pocket coils 61 lined four deep from left to right and five deep from front to rear.

Figure 3:
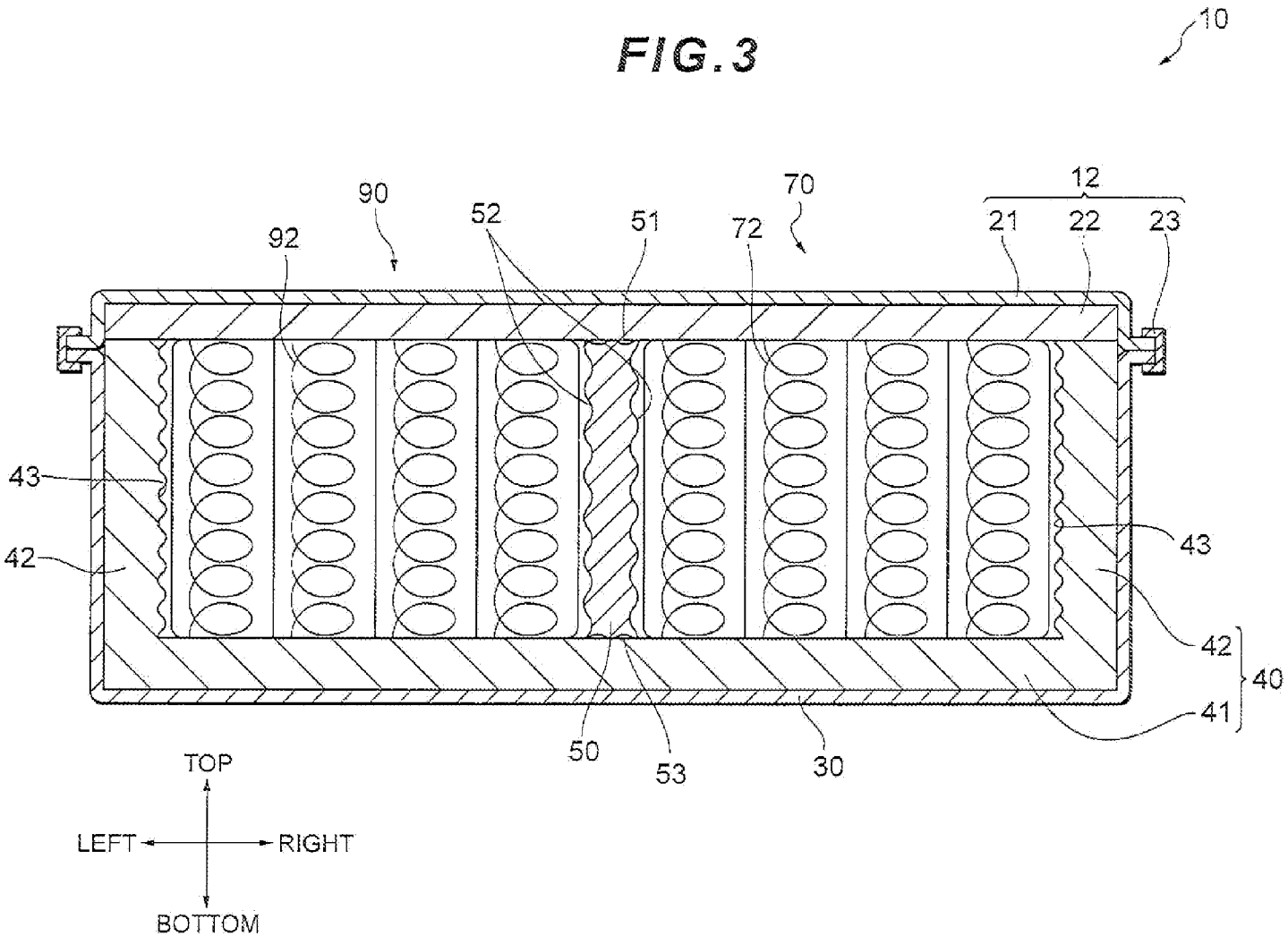
FIG. 3 is a cross-sectional view depicting the portion III-III in FIG. 1.

The spring unit 70 has essentially the same configuration as compared with the above-described spring unit 60 (see FIG. 3, etc.). The coil spring 72 of the spring unit 70 used herein is, for example, a metal wire made of the same material as the metal wire of the coil spring 62, but thicker than the wire diameter of the coil spring 72. Therefore, the spring unit 70 has elastic characteristics that make the unit more difficult to be depressed (to be harder) under a downward-acting load, compared with the spring unit 60 described above.

The spring unit 80 has the same configuration as the above-described spring unit 60 and has the same elastic characteristics as the spring unit 60. The spring unit 90 has the same configuration as the above-described spring unit 70 and has the same elastic characteristics as the spring unit 70. Further, the spring units 60, 70, 80, 90 are formed in substantially the same shape.

The upper layer unit 12, as depicted in FIG. 3, is primarily constituted of an upper enclosure 21, an upper elastic body 22, and a zipper 23. The upper elastic body 22 is formed in a substantially rectangular shape in plan view from above using an elastic material such as a urethane resin. The upper elastic body 22 is shaped to be able to cover the housing space 44 of the lower elastic body 40. The upper enclosure 21 covers the upper surface of the above-described upper elastic body 22. The upper enclosure 21 is formed with layers of, for example, a non-woven cloth, an elastic urethane resin, polyester fibers, a softly textured surface fabric, or the like (not shown), in order from the inside (from the upper elastic body 22). The zipper 23 is attached to the right and left ends of the upper enclosure 21. The end of the upper enclosure 21 and the end of the lower enclosure 30 can be fastened together by the zipper 23.

The above is a description of the configuration of the mattress 10. The following is a description of the assembly configuration of the mattress 10.

First, the partitioning elastic body 50 is inserted into the housing space 44 of the lower elastic body 40, the bottom surface and side surface of which are covered by the lower enclosure 30. In so doing, the housing space 44 is divided into four substantially rectangular cuboids having substantially the same shape as each other. Then, for example, as illustrated in FIG. 1, the spring unit 60 is inserted into the front right space, the spring unit 80 is inserted into the front left space, the spring unit 70 is inserted into the rear right space, and the spring unit 90 is inserted into the rear left space. In so doing, the spring units 60 to 90 are held by the lower elastic body 40 and the partitioning elastic body 50. The configuration of the partitioning elastic body 50 may be a fixed bond to the lower elastic body 40, or may merely be simple insertion into the housing space 44. Next, the upper layer unit 12 is laid onto the housing space 44 to cover the same, and the end of the upper enclosure 21 and the end of the lower enclosure 30 are fastened together with the zipper 23. The mattress 10 is assembled in this manner.

Figure 4B:
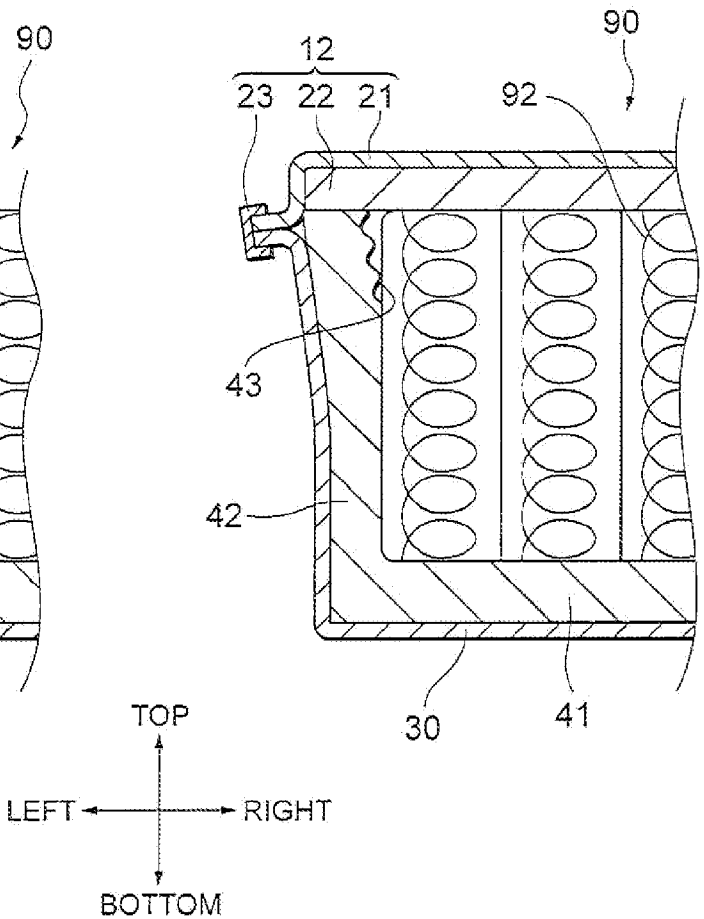
FIG. 4B depicts a cross-sectional view of a state in which the zipper has been closed with the side wall unit being tilted.
Figure 4A:
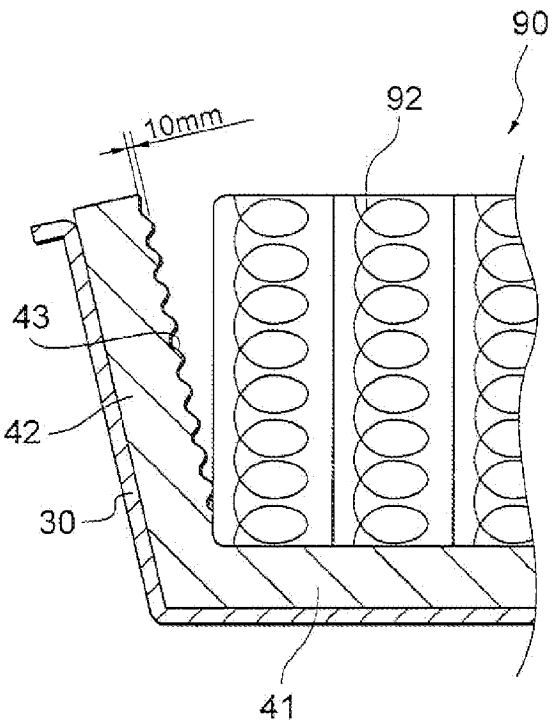
FIG. 4A depicts a cross-sectional view of a state in which a spring unit has been inserted while shifted substantially to the left.

Upon assembly as described above, a spring unit is sometimes displaced to the left or right or to the front or rear when inserted into a space divided by the partitioning elastic body 50. FIG. 4A illustrates a cross-sectional view of the state in which the spring unit 90 has shifted to the left during insertion. Thus, for example, when the spring unit 90 has shifted to the left during insertion, the side wall unit 42 and the bottom part of the spring unit 90 interfere with each other, and the side wall unit 42 is inclined outward (to the left).

The zipper 23 is generally difficult to close when the side wall unit 42 remains in the inclined state, as in FIG. 4A. Therefore, in a mattress having a conventional configuration in which the lateral projections 43 are not formed on the side wall unit 42, an attempt is sometimes made to forcibly push the side wall unit 42 to the right to position the side wall unit 42 to be substantially straight in the up-down direction and to shut the zipper 23. In this case, because the side wall unit 42 and the side surface of the spring unit 90 are in contact along a plane, it is difficult to contract the side wall unit 42 even by pushing the side wall unit 42 to the right. Accordingly, the problem occurs in which it is difficult to position the side wall unit 42 to be substantially straight in the up-down direction, and the zipper 23 is difficult to close. Therefore, sufficient consideration must be given to faulty positioning in the conventional configuration during insertion of the spring unit.

On the other hand, in the mattress 10 in which the present invention is adopted, the lateral projections 43 are formed on the side wall unit 42. Therefore, in the state in which the side wall unit 42 is inclined as in FIG. 4A, the lateral projections 43 and the side surfaces of the spring unit 90 are brought into contact at points by the side wall unit 42 being lightly pushed to the right. Therefore, the lateral projections (side wall unit 42) are more easily contracted compared with the conventional case of contact along a plane. Accordingly, in a case in which the spring unit 90 is only moderately displaced to the left, the side wall unit 42 can be easily positioned to be substantially straight in the up-down direction, and the zipper 23 can be reliably closed.

In a case in which the spring unit 90 is comparatively greatly displaced to the left, the side wall unit 42 can be positioned to be substantially straight to a certain extent in the up-down direction by contracting the lateral projections 43

(see FIG. 4B), and the zipper 23 can be closed. Thus, in the mattress 10 in which the present invention is adopted, the zipper 23 can be reliably closed without giving detailed consideration to displacement when the spring units are inserted. The above description is for lateral projections 43 formed on the side wall unit 42, but lateral projections 52 formed on the partitioning elastic body 50 have the same effect as the lateral projections 43.

The above is a description of the assembly configuration of the mattress 10. The following is a description of the manner in which the mattress 10 thus assembled is used.

In a case in which there is a preference for a mattress having the elastic characteristics of being, for example, softer at the upper body and harder at the lower body, the user will recline on the mattress 10 with the head toward the front and the feet towards the rear. In so doing, the upper body is supported by the softer spring unit 60 and spring unit 80, and the lower body is supported by the harder spring unit 70 and spring unit 90. Accordingly, the user is supported in a state in which the upper body is comparatively easy to depress (is softer), and is supported in a state in which the lower body is comparatively difficult to depress (is harder). The user is therefore able to recline on the mattress 10 having elastic characteristics in accordance with their preference, and to obtain a comfortable rest with a natural sleeping position.

The following is a description of a case in which the user preference has changed and, for example, the preference is for a mattress having the elastic characteristics of being harder for the upper body and softer for the lower body. In this case, the zipper 23 is opened, the positions of the spring unit 60 and spring unit 70 are switched when the units are inserted into the housing space 44, and the positions of the spring unit 80 and spring unit 90 are also switched when the units are inserted. In so doing, the user's upper body is supported by the harder spring unit 70 and spring unit 90, and the lower body is supported by the softer spring unit 60 and spring unit 80. Thus, in the mattress 10 in which the present invention is adopted, the elastic characteristics of each portion can be promptly altered by the convenient method of simply replacing the spring units.

The user, by reclining on the mattress 10, applies a downward load on the mattress 10 and depresses the mattress in accordance with this load. At this time, when, for example, a certain portion of the mattress takes on extremely hard elastic characteristics compared with the periphery thereof, the user may be inconvenienced and their comfort may be compromised. In order to prevent such a situation, the mattress 10 in which the present invention is adopted is provided with a plurality of upper projections 51 formed on the top surface of the partitioning elastic body 50 as described above. These upper projections 51 can cause the partitioning elastic body 50 and the upper layer unit 12 to be brought into contact at points.

Figure 5:
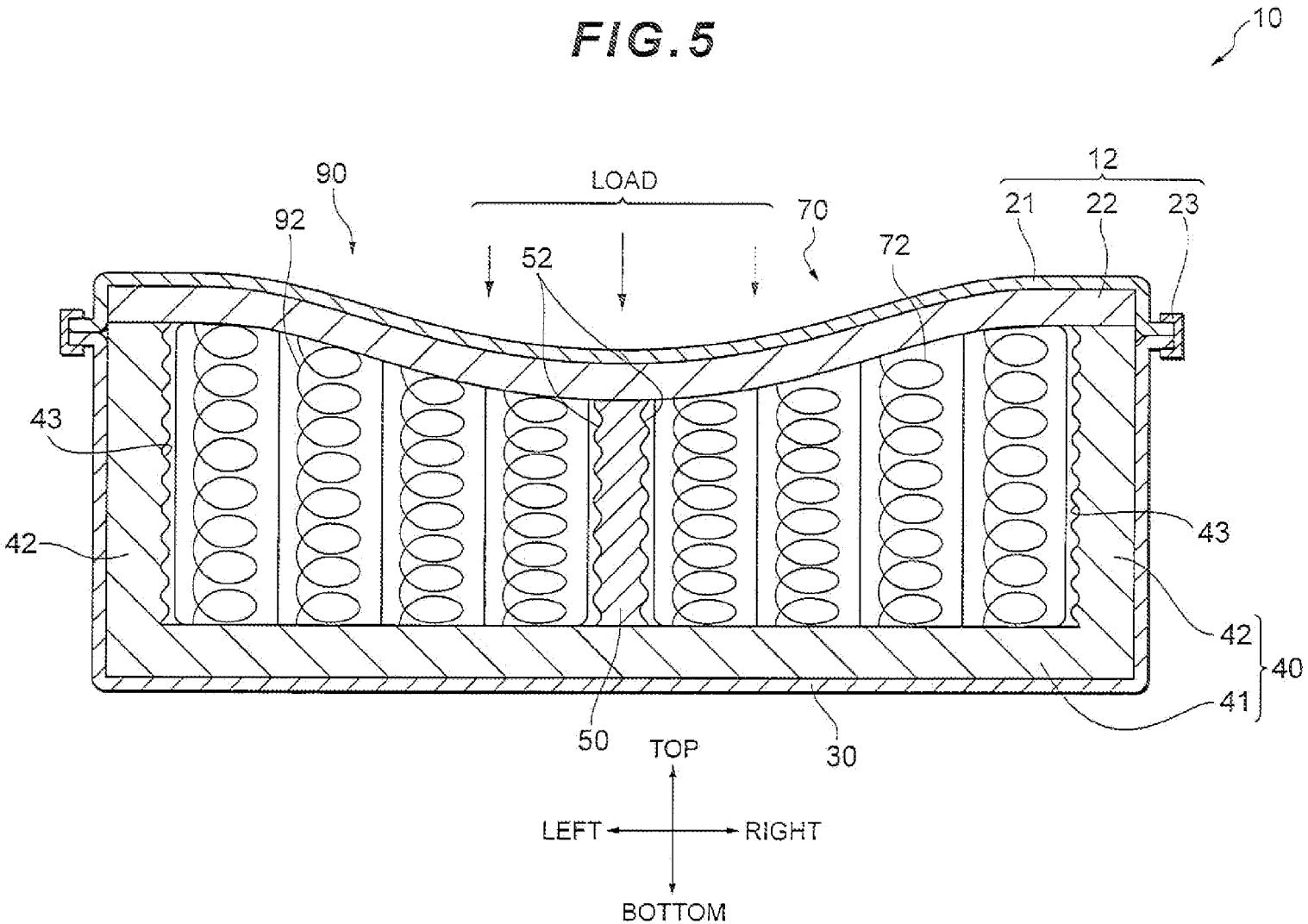
FIG. 5 is a cross-sectional view of a state in which a load is applied from above.

Therefore, compared with a configuration in which the partitioning elastic body 50 and the upper layer unit 12 are brought into contact along a plane, the partitioning elastic body 50 can be more easily depressed downward under a load applied to the mattress 10. Accordingly, as depicted in FIG. 5, applying a load to the mattress 10 will not inconvenience the user because the partitioning elastic body 50 is depressed to the same extent as the adjacent spring unit 70 and spring unit 90. There may be a case in which the mattress 10 is to be used so that the top and bottom are inverted (upside down) relative to the state depicted in FIG. 5, with the load being applied to the underside thereof. In this case, the same effect is achieved by the plurality of lower projections formed on the bottom surface of the partitioning elastic body 50 as with the above-described upper projections 51. Therefore, the user will not be inconvenienced.

Figures 6A, 6B, 6C, 6D:
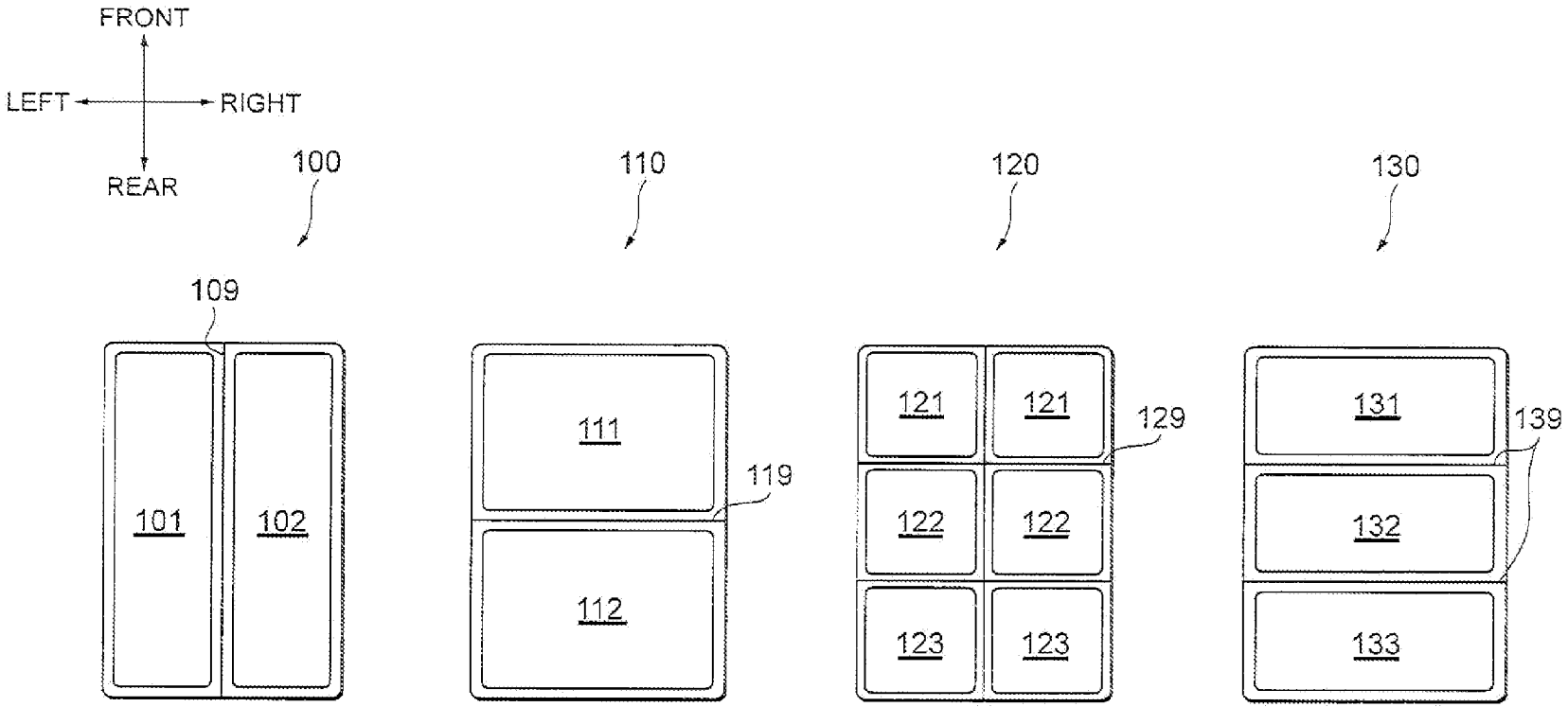
FIG. 6A to FIG. 6D are plan views of the mattress according to another embodiment.

In addition to the configuration in which the housing space 44 is divided into four by the partitioning elastic body 50, as depicted in FIG. 1, configurations such as those depicted, for example, in FIGS. 6A to 6D are also possible. FIG. 6A illustrates a double-bed mattress 100 configured so that the housing space is divided left and right into two parts by a partitioning elastic body 109, with a spring unit 101 and a spring unit 102 being inserted into these divided spaces. FIG. 6B illustrates a single-bed (semi-double) mattress 110 configured so that the housing space is divided front and rear into two parts by a partitioning elastic body 119, with a spring unit 111 and a spring unit 112 being inserted into these divided spaces.

FIG. 6C illustrates a double-bed mattress 120 configured so that the housing space is divided front, rear, left, and right, by a partitioning elastic body 129 into six parts, with six spring units 121 to 123 being inserted into these divided spaces. FIG. 6D illustrates a single-bed (semi-double) mattress 130 configured so that the housing space is divided front and rear into three parts by a partitioning elastic body 139, with three spring units 131 to 133 being inserted into these divided spaces.

In the mattresses 100 to 130 depicted in FIGS. 6A to 6D, it is possible to configure a mattress having a high degree of comfort in which the user preference is faithfully reflected by the use of spring units formed to the preferred elastic characteristics for each spring unit, and by the insertion thereof into preferred positions. Moreover, as described above, various user preferences can be accommodated easily and promptly by replacing the spring units.

The embodiments described above illustrate the case in which the spring unit 60 and spring unit 70 are configured with different elastic characteristics by the use of coil springs made from metal wires having different wire diameters, but the present invention is not limited to this configuration. For example, it is possible to configure the spring units with mutually different elastic characteristics that correspond to user preferences by using metal wires of different materials, by changing the arrangement of the pocket coils, by changing the lengths of the coil springs, or the like.

The embodiments described above illustrate the configuration in which the lower elastic body 40 and the partitioning elastic body 50 are formed separately and the partitioning elastic body 50 is inserted into the lower elastic body 40, but the present invention is not limited to this configuration. For example, it is also possible to use a molding die and form the lower elastic body 40 and the partitioning elastic body 50. When the mattress is configured in this manner, the number of parts can be reduced and manufacturing costs curtailed.

The embodiments mentioned above are described by illustrating a configuration in which two types of spring units are used with softer and harder elastic characteristics, but the present invention is not limited to this configuration. For example, spring units are prepared with three or more types of hardness, such as softer, standard hardness, and harder. The user can be provided with a comfortable mattress that faithfully reflects the user's preference by selecting spring units of a preferred hardness and inserting the same into desired positions.

EXPLANATION OF NUMERALS AND CHARACTERS

10 Mattress
21 Upper enclosure (enclosure)
31 Lower enclosure (enclosure)
40 Lower elastic body (housing holding member)
43 Lateral projections (laterally extending irregularities)
44 Housing space (unit-housing recess)
50 Partitioning elastic body (dividing member)
51 Upper projections (irregularities in the vertical direction)
53 Lower projections (irregularities in the vertical direction)
60 Spring unit
62 Coil spring
70 Spring unit
80 Spring unit
90 Spring Unit

The invention claimed is:

1. A mattress comprising:

a plurality of spring units respectively constituted by holding a plurality of vertically stretchable coil springs integrally;

a housing holding member in which a unit-housing recess capable of housing and holding the plurality of spring units is formed; and an enclosure covering the outer periphery of the housing holding member;

wherein the mattress is configured so that the housing holding member is provided with a dividing member to divide the unit-housing recess into a plurality of divided housing recesses; and the plurality of spring units is formed in such a shape that each of the spring units is housed in the divided housing recesses, and is housed and held in the respective recesses of the plurality of divided housing recesses, wherein the dividing member is formed using an elastically deformable plate-shaped member and is housed in the unit-housing recess, and the dividing member, when housed in the unit-housing recess, has irregularities in the vertical direction formed on at least one of the end faces in the vertical direction.

2. The mattress according to claim 1, wherein the elastic characteristics, as measured in the vertical direction, of one of the spring units constituting the plurality of spring units are different from the elastic characteristics of at least one other of the spring units in the vertical direction.

3. The mattress according to claim 2, wherein:

the dividing member is formed using an elastically deformable plate-shaped member and is housed in the unit-housing recess, and the dividing member, when housed in the unit-housing recess, has irregularities in the vertical direction formed on at least one of the end faces in the vertical direction.

4. The mattress according to claim 3, wherein:

the housing holding member is provided with the unit-housing recesses formed to be substantially box-shaped using an elastically deformable material so that the top surface in the vertical direction is depressed; and laterally extending irregularities are formed on the inner sides facing the side surface of the spring units in the housing holding member in a state in which the spring units are housed and held in the dividing housing recesses.

5. The mattress according to claim 2, wherein:

the housing holding member is provided with the unit-housing recesses formed to be substantially box-shaped using an elastically deformable material so that the top surface in the vertical direction is depressed; and laterally extending irregularities are formed on the inner sides facing the side surface of the spring units in the housing holding member in a state in which the spring units are housed and held in the dividing housing recesses.

6. The mattress according to claim 1, wherein:

the housing holding member is provided with the unit-housing recesses formed to be substantially box-shaped using an elastically deformable material so that the top surface in the vertical direction is depressed; and laterally extending irregularities are formed on the inner sides facing the side surface of the spring units in the housing holding member in a state in which the spring units are housed and held in the dividing housing recesses.

7. A mattress comprising:

a plurality of spring units, each including a plurality of vertically stretchable coil springs;

a housing holding member in which a plurality of unit-housing recesses capable of housing and holding each of the spring units is formed;

a dividing member to divide the unit-housing recess; and an enclosure covering an outer periphery of the housing holding member;

wherein the plurality of spring units are formed in such a shape that each of the spring units is housed in the unit-housing recesses and is housed and held in the respective recesses of the plurality of unit-housing recesses, and wherein the dividing member is formed using an elastically deformable plate-shaped member and is housed in the unit-housing recess, and the dividing member, when housed in the unit-housing recess, has irregularities in the vertical direction formed on at least one of the end faces in the vertical direction.

8. The mattress according to claim 7, wherein the elastic characteristics, as measured in the vertical direction, of one of the spring units constituting the plurality of spring units are different from the elastic characteristics of at least one other of the spring units in the vertical direction.

* * * * *